US008376509B2

(12) United States Patent
Wong et al.

(10) Patent No.: US 8,376,509 B2
(45) Date of Patent: Feb. 19, 2013

(54) APPARATUS FOR WIPING

(75) Inventors: Hoong Wai Wong, Singapore (SG); Chiok Liang Tay, Singapore (SG); Eng Hua Leong, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 345 days.

(21) Appl. No.: 12/533,212

(22) Filed: Jul. 31, 2009

(65) Prior Publication Data

US 2011/0025757 A1 Feb. 3, 2011

(51) Int. Cl.
*B41J 2/165* (2006.01)

(52) U.S. Cl. ..... 347/33

(58) Field of Classification Search ..... None
See application file for complete search history.

(56) References Cited

U.S. PATENT DOCUMENTS 5,757,395 A 5/1998 Chew et al.
5,812,157 A 9/1998 Nguyen et al.
5,949,448 A 9/1999 Man et al.
6,155,667 A 12/2000 Eckard et al.
6,454,373 B1 9/2002 Therien et al.
6,454,374 B1 9/2002 Therien
6,491,366 B1 12/2002 Therien
6,497,471 B1 12/2002 Gargir
6,533,377 B2 3/2003 Su et al.
6,550,887 B2 4/2003 Therien et al.
6,568,789 B2 * 5/2003 Lin et al. ..... 347/33
6,698,864 B2 3/2004 Therien
6,742,864 B2 6/2004 Therien et al.
6,761,429 B2 7/2004 Su et al.
6,764,168 B1 7/2004 Meinhold et al.
6,913,340 B2 * 7/2005 Tanaka et al. ..... 347/29
2007/0242111 A1 10/2007 Pamula et al.

* cited by examiner

*Primary Examiner* — Matthew Luu
*Assistant Examiner* — Alejandro Valencia
(74) *Attorney, Agent, or Firm* — Garry A. Perry

(57) ABSTRACT

An apparatus for wiping is disclosed. In one embodiment, the apparatus for wiping includes a wiper arm, including a wiping end and a first track, a pin engaging the first track, a second track engaging the pin, and an appendage engaging the pin.

17 Claims, 12 Drawing Sheets

APPARATUS FOR WIPING

BACKGROUND

Current inkjet printers may utilize a drop detector to detect characteristics of ejected ink drops. The characteristics of the ejected ink drops may be used to assess the state of structural and operational features of the printer. For example, detecting the number, size and/or shape of ink drops may help determine whether nozzles through which ink drops are supposed to be ejected are partially or fully clogged. Information regarding the characteristics of ejected ink drops and clogged nozzles may be used in applying error-hiding algorithms and other corrective procedures to improve print quality.

If fibers or other contaminants block ink drops from reaching a drop detector's sensor board, the drop detector will return inaccurate information regarding the ink drop characteristics and nozzle health. Such inaccurate information may diminish the effectiveness of corrective measures and negatively affect print quality.

BRIEF DESCRIPTION OF THE DRAWINGS

The accompanying drawings illustrate various embodiments and are a part of the specification. The illustrated embodiments are merely examples and do not limit the scope of the claims. Throughout the drawings, identical reference numbers designate similar, but not necessarily identical elements.

The same part numbers designate the same or similar parts throughout the figures.

DETAILED DESCRIPTION OF EMBODIMENTS

Embodiments of the apparatus for wiping were developed in an effort to clear fibers and other contaminants from the path of ink drops to a drop detector, and to thereby improve drop detector and printing performance. Embodiments are described with reference to a drop detector and a printing device. The embodiments shown in the accompanying drawings and described below, however, are non-limiting examples. Other embodiments are possible and nothing in the accompanying drawings or in this Detailed Description of Embodiments should be construed to limit the scope of the disclosure, which is defined in the claims.

Figure 1:
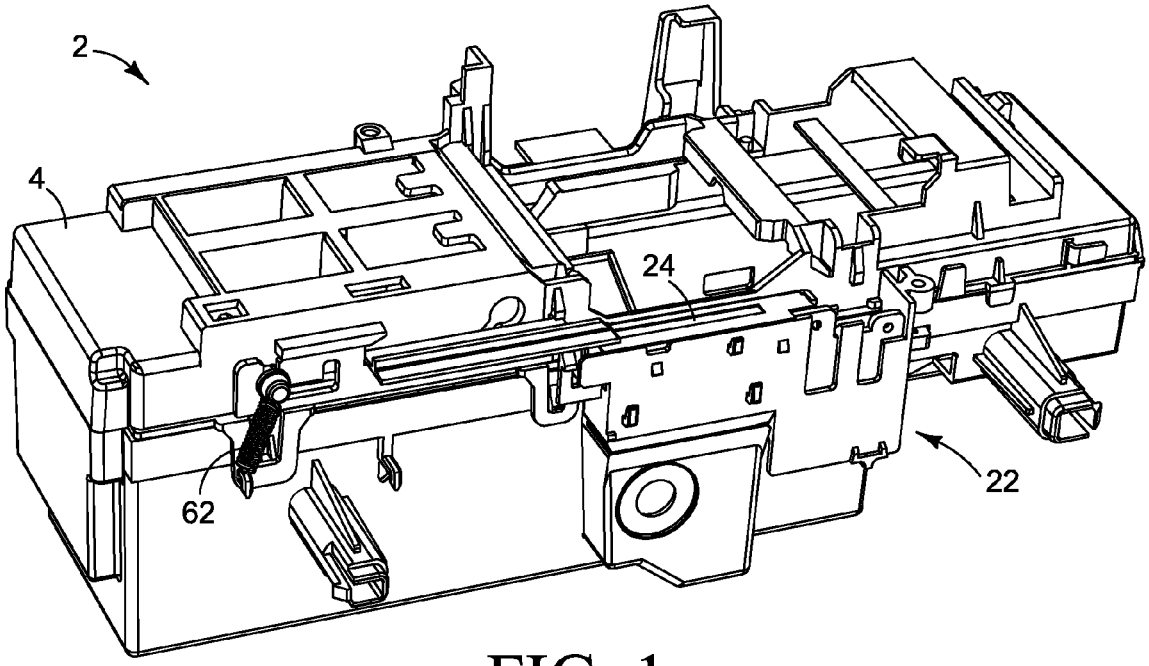
FIG. 1 is a diagram of one embodiment of an inkjet printer service station with a bonnet.

FIG. 1 is a diagram of one embodiment of an inkjet printer service station, with a bonnet. In inkjet printing, ink passes from a printhead reservoir through a multiplicity of nozzles to be ejected onto a print medium. Inkjet printhead nozzles commonly become plugged with ink blobs or particulate, and other contaminants that prevent the nozzles from operating properly resulting in low print quality. Consequently, inkjet printing devices often include a service station that provides for spitting, wiping, capping and/or priming of the printhead in order to keep the nozzles clean and functioning.

Exemplary service station 2 includes a bonnet 4, which bonnet 4 covers the service station 2. The bonnet 4 serves as the upper structure of the service station 2, and serves to protect elements of the service station 2 (discussed below) from aerosol and other contaminants. Exemplary service station 2 includes a drop detector 22, for detecting characteristics of ejected ink drops. In the exemplary embodiment the drop detector 22 is an electrostatic drop detector. In alternative embodiments, the drop detector 22 may detect drops by optical or other means. In an embodiment, the drop detector 22 includes an entrance slot 24, through which ink drops pass after being ejected by a printhead, and before making their way past a vertically-positioned electrostatic sensor that detects the ink drops and characteristics of the ink drops.

Figure 1A:
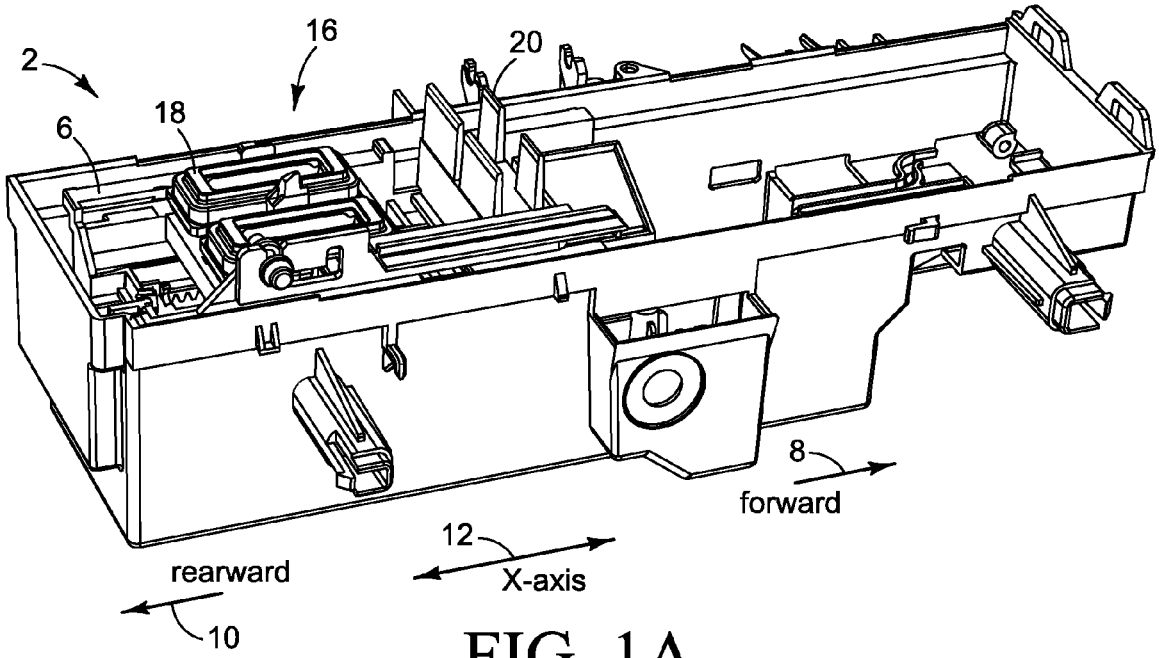
FIG. 1A is a diagram of the service station of FIG. 1, with the bonnet removed.

FIG. 1A is a diagram of the service station of FIG. 1, with the bonnet removed. As shown in FIG. 1A, the exemplary service station 2 includes a shuttle 6 that is movably attached to the service station 2. The shuttle 6 moves forward 8 and rearward 10 relative to the X-axis 12, being propelled by an actuator. As used in this specification and the appended claims, "forward" with respect to movement of the shuttle 6 or appendage means movement along the X-axis 12 in a direction towards the object to be wiped relative to the home position 16 of the shuttle 6 or appendage, as applicable. As used in this specification and the appended claims, "rearward" with respect to movement of the shuttle 6 or appendage means movement along the X-axis 12 in a direction towards the home position 16 of the shuttle 6 or appendage, as applicable relative to the object to be wiped. As used in this specification and the appended claims, "home position" with respect to a shuttle 6 or appendage means the position in which the shuttle 6 or appendage, as applicable, returns to and rests in normal operations.

In an embodiment, the actuator may include a pinion-gear-rack system connecting to a drive shaft. In an embodiment, a printhead cap 18 is mounted to the shuttle 6, for capping a printhead. In an embodiment, the shuttle 6 is moved laterally into a capping position, and vertical movement of the printhead cap 18 relative to a printhead causes the printhead cap 18 to enclose the nozzles of the printhead. The printhead cap 18 seals the printhead nozzles from contaminants and prevents drying during storage and during non-printing periods. In an embodiment the printhead cap 18 may be connected to a pumping unit to draw a vacuum on a printhead, thereby facilitating a negative-pressure priming event. A negative-pressure priming event includes cleaning external contaminants and/or purging internal dried ink plugs from a printhead by forcibly extracting ink from the printhead using negative pressure.

As shown in FIG. 1A, a printhead wiper 20 may be mounted to the shuttle 6. The printhead wiper 20 may be in the form of an elastomeric structure that wipes printhead surface to remove ink residue, as well as any paper dust and other debris that have collected on a printhead. In an embodiment, forward 8 and rearward 10 movement of the shuttle 6 causes the printhead wiper 20 to wipe across the printhead. The printhead wiping routine may be performed after a negative pressure priming event. The printhead wiping routine may also be performed after a positive-pressure priming event. A positive-pressure priming event includes cleaning external contaminants and/or purging internal dried ink plugs from a printhead by forcibly extracting ink from the printhead using positive pressure. The printhead wiping routine may also be performed after a spitting event. A spitting event includes a maintenance routine to clear ink and contaminants from a printhead by firing a number of drops of ink through the printhead's nozzles. The printhead wiping routine may also be performed after any other event that involves uncapping. The printhead wiping routine may also be performed periodically during printing.

The exemplary service station 2 includes an apparatus for wiping for removing fibers, bits of print medium and other contaminants from the entrance slot 24. Such contaminants otherwise would accumulate and block ink drops from passing through the entrance slot 24, thereby making unreliable the readings of the drop detector 22. The apparatus for wiping is discussed in more detail below in FIGS. 2-11.

Figure 2:
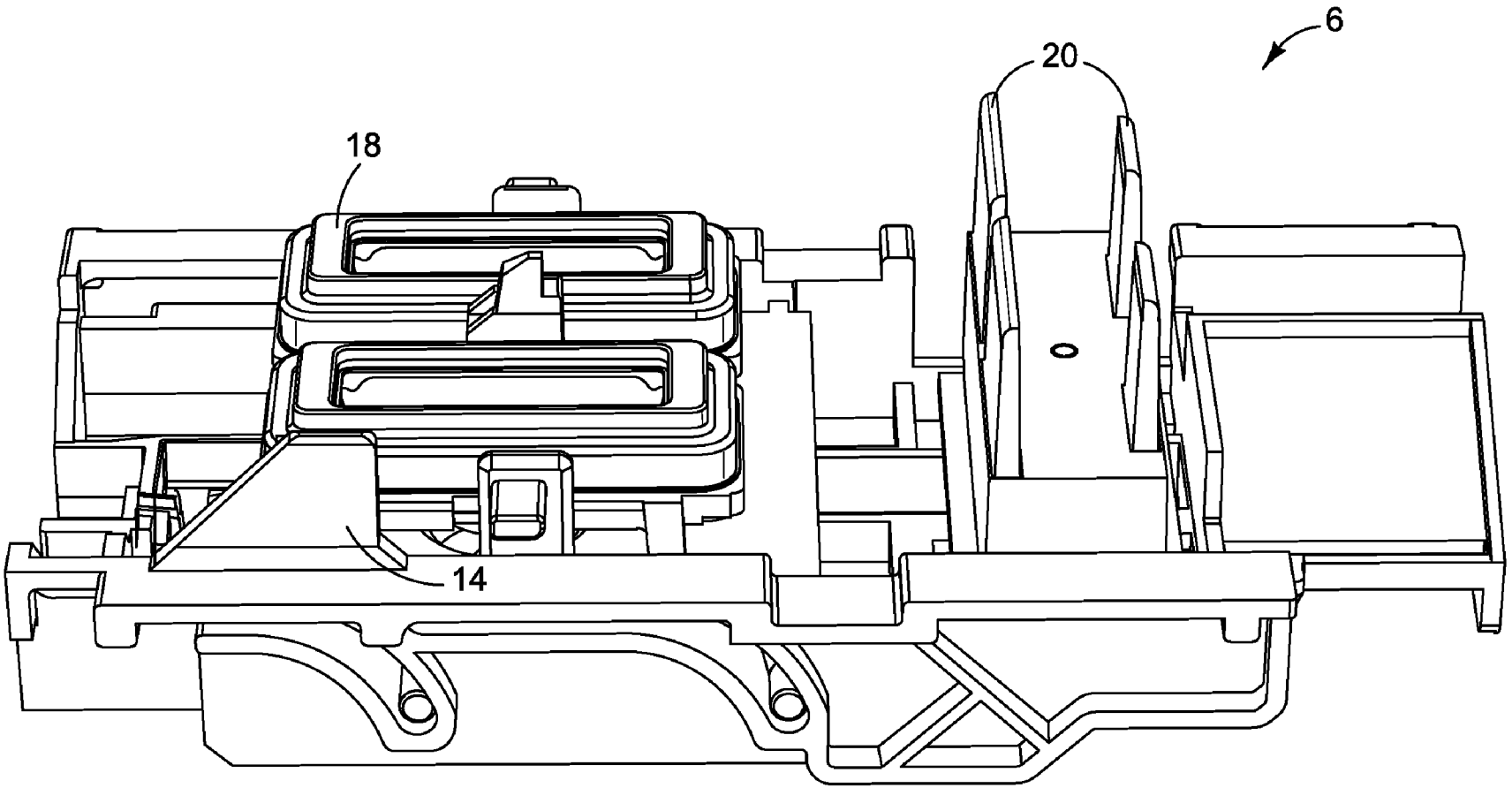
FIG. 2 is a cutaway diagram of one embodiment of an apparatus for wiping, illustrating a shuttle.

FIG. 2 is a cutaway diagram of one embodiment of an apparatus for wiping, illustrating a shuttle. In the exemplary embodiment, the shuttle 6 includes a printhead cap 18 and a printhead wiper 20. The shuttle 6 connects to an appendage 14, which appendage 14 can engage a pin in various positions as described in FIGS. 7-11 below. In an embodiment the appendage 14 is an independent part removably connected to the shuttle 6. In an embodiment the shuttle 6 and the appendage 14 are irremovably connected by virtue of having been molded together. In an embodiment the appendage 14 is attached to the shuttle 6 using injection overmolding. In an embodiment the shuttle 6 and the appendage 14 are constructed of plastic.

Figure 3:
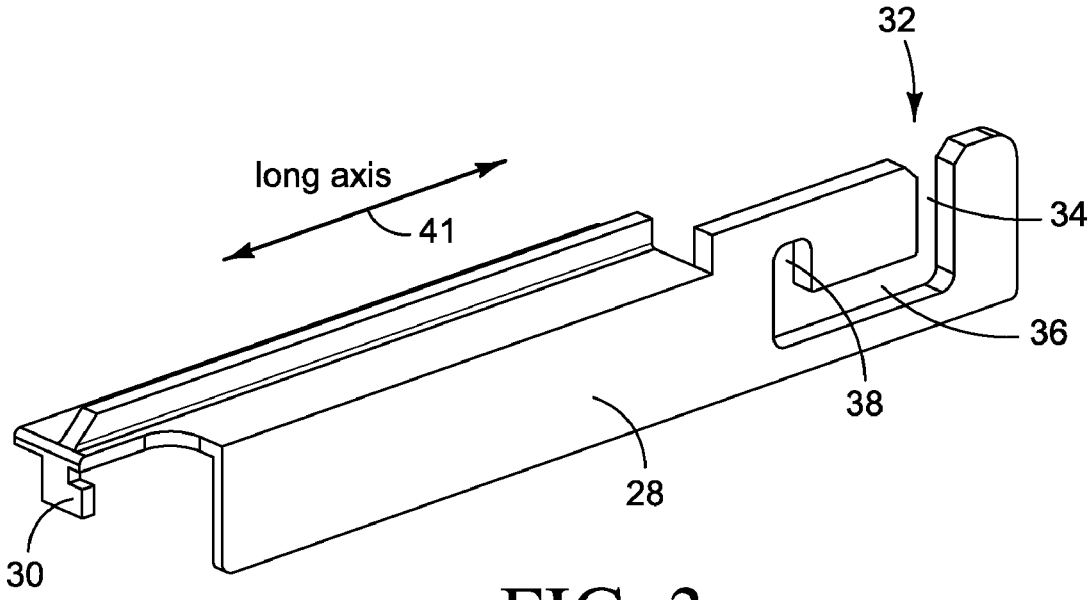
FIG. 3 is a cutaway diagram of the apparatus for wiping of FIG. 2, illustrating a wiper arm.

FIG. 3 is a cutaway diagram of the apparatus for wiping of FIG. 2, illustrating a wiper arm 28. Wiper arm 28 includes a wiping end 30. In an embodiment, wiping end 30 is configured to wipe an entrance slot 24 of a drop detector 22, so as to remove fibers, dust, bits of print medium and other contaminants that might otherwise block ink drops from reaching the drop detector's sensor. In an embodiment the wiper arm 28 is constructed of plastic.

The wiper arm 28 includes a first track 32 for engaging a pin 26. The first track 32 includes a first vertical portion 34, a horizontal portion 36, and a second vertical portion 38. In an embodiment, the first track 32 is situated opposite of the wiping end 30. Details regarding how the various portions of the first track 32 engage the pin 26 to drive and control the pin 26 (and indirectly the wiper arm 28) are addressed in the discussion of FIGS. 7-11 below. References in this application and in the claims to a pin 26 engaging a portion of the first track 32 contemplate that the pin 26 is engaging structure that defines that portion of the first track 32.

Figure 4:
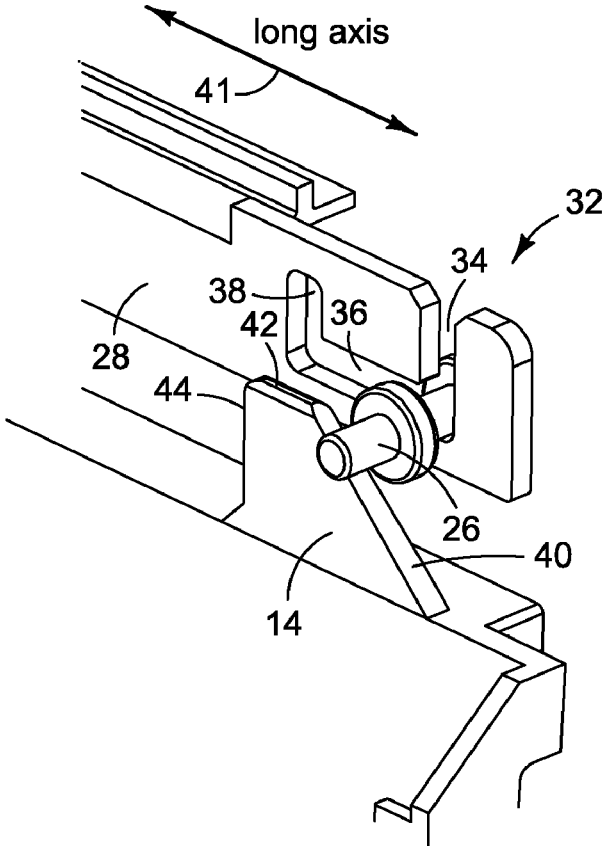
FIG. 4 is a cutaway diagram of the apparatus for wiping of FIG. 2, illustrating an appendage.

FIG. 4 is a cutaway diagram of the apparatus for wiping of FIG. 2, illustrating an appendage 14. In an embodiment, appendage 14 includes a ramp portion 40 with a slope, of approximately forty-five degrees for example, with respect to a long axis 41 of the wiper arm 28. The appendage 14 includes a top portion 42 that is substantially parallel to the long axis 41 of the wiper arm 28. In the exemplary embodiment, the appendage 14 also includes a vertical portion 44 with a slope, of approximately ninety degrees for example, with respect to the long axis 41 of the wiper arm 28. The ramp portion 40, top portion 42 and vertical portion 44 engage the pin 26 in various positions to facilitate, and control, movement of the wiper arm 28, which positions are addressed in detail in the discussion of FIGS. 7-11 below.

Figure 5:
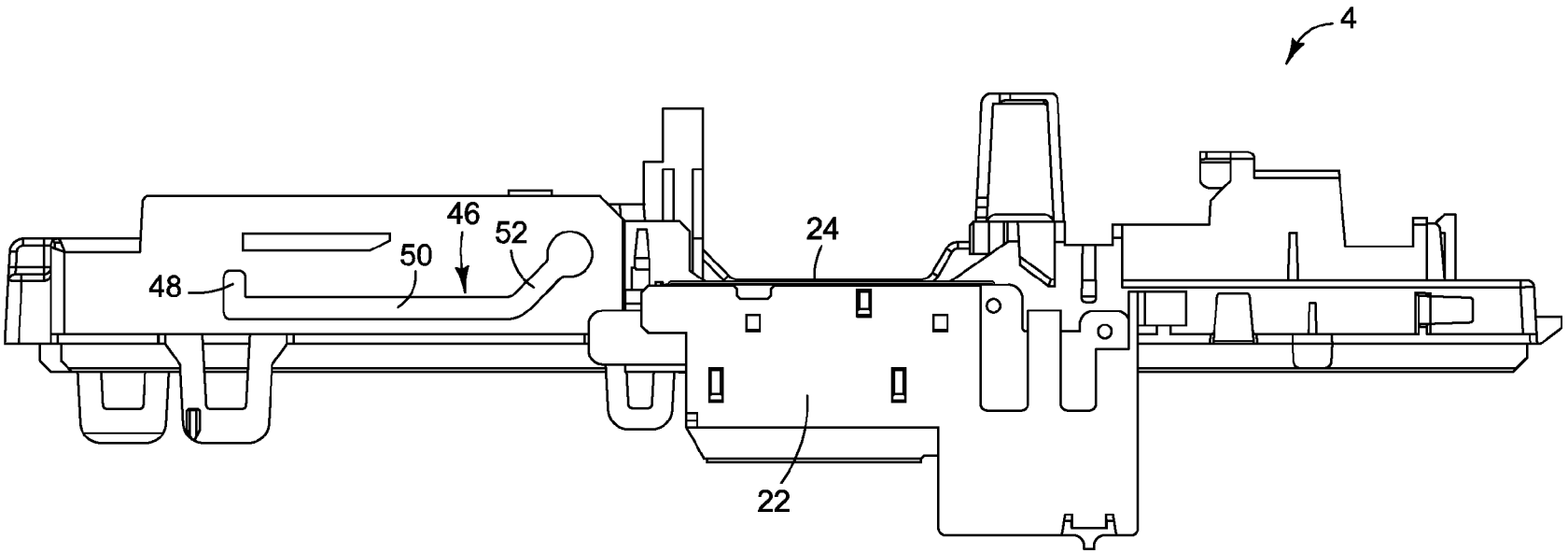
FIG. 5 is a lateral view diagram of the apparatus for wiping of FIG. 2, illustrating a bonnet including a second track.

FIG. 5 is a lateral view diagram of the apparatus for wiping of FIG. 2, illustrating the bonnet including a second track. The apparatus for wiping includes a second track 46, for guiding a pin 26 and thereby controlling movement of the wiper arm 28. In an embodiment the second track 46 is a part of the bonnet 4, which bonnet 4 covers and protects the service station 2. In an embodiment the second track 46 may be an independent part that that irremovably connects to the bonnet 4 or to other structure of the service station 2. The second track 46 includes a vertical portion 48, a horizontal portion 50, and a ramp portion 52, all for engaging a pin 26 in various positions described in detail in the discussion of FIGS. 7-11 below. References in this application and in the claims to a pin 26 engaging a portion of the second track 46 contemplate that the pin 26 is engaging structure that defines that portion of the second track 46.

Figure 6:
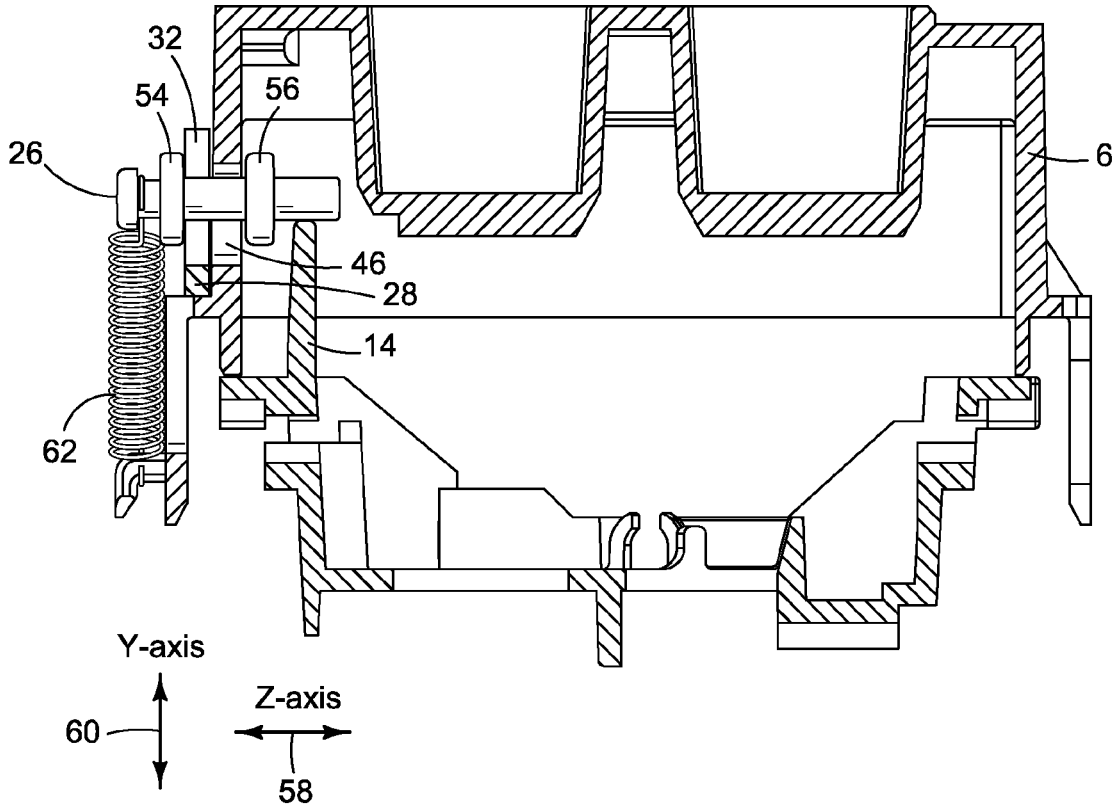
FIG. 6 is a cross-section diagram of the apparatus for wiping of FIG. 2, illustrating a pin.

FIG. 6 is a cross-section diagram of the apparatus for wiping of FIG. 2, illustrating a pin. In an embodiment the structure of the bonnet 4 includes a second track 46 for guiding and controlling the pin 26. The wiper arm 28 includes a first track 32, also for guiding and controlling the pin 26. The shuttle 6 connects to an appendage 14, the appendage 14 for engaging the pin 26 so as to guide and control the pin 26.

In an embodiment, the pin 26 includes a lateral collar 54 and a medial collar 56, the lateral collar 54 and the medial collar 56 for holding the pin 26 in position in the Z-axis 58 as the pin 26 engages and navigates the first track 32 and the second track 46. The pin 26 is moved in forward and rearward (along an X-axis), and up and down (along a Y-axis 60) by its interaction with the ramp portion 40, top portion 42, and vertical portion 44 of the appendage 14, by the pin's interaction with the first vertical portion 34, horizontal portion 36, and second vertical portion 38 of the first track 32, and by the pin's interaction with the vertical portion 48, horizontal portion 50, and ramp portion 52 of the second track 46.

In an embodiment, the apparatus for wiping includes a biasing mechanism 62 connecting to the pin 26 and to an anchor, for biasing the pin 26 towards the rear of the service station 2, and downwards. In an embodiment, the biasing mechanism 62 includes a spring, and the anchor is part of the bonnet 4 structure.

Figure 7:
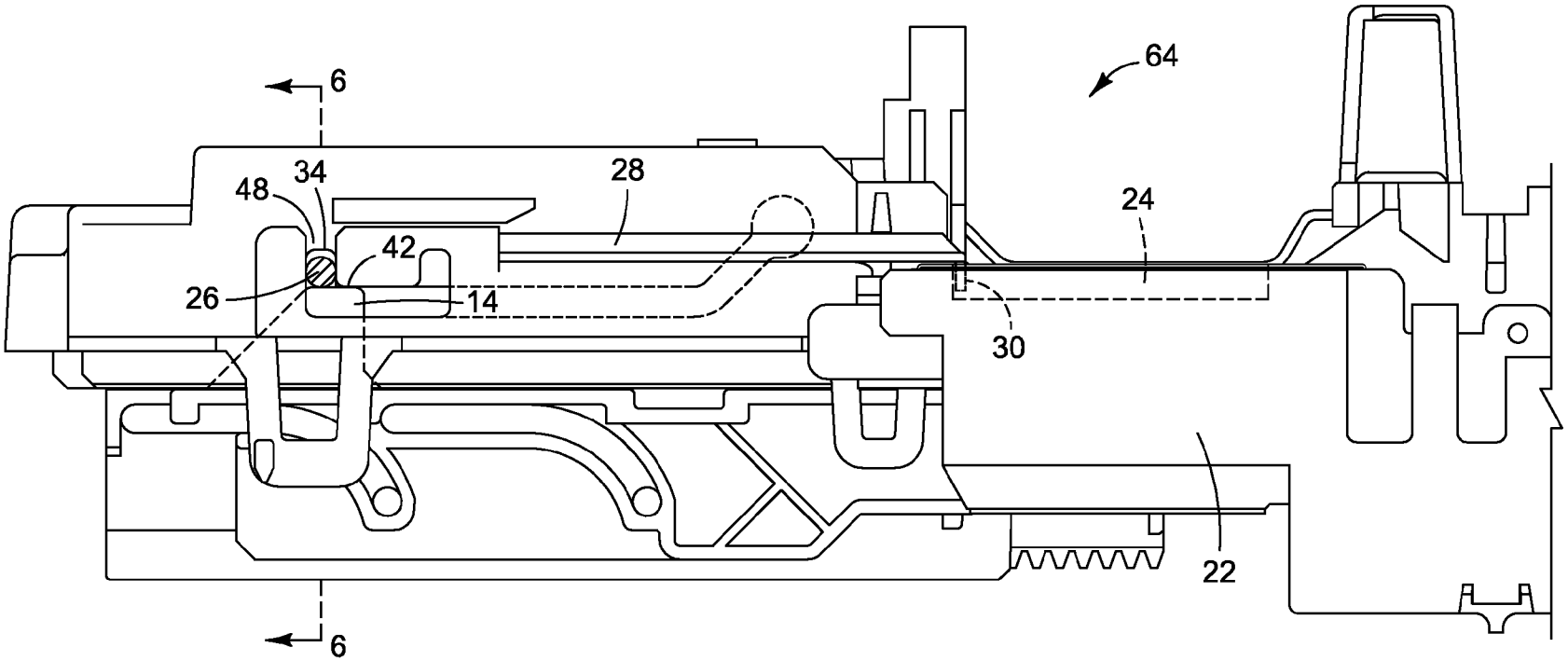
FIG. 7 is a diagram of the apparatus for wiping of FIG. 2, illustrating the pin in a home position.

FIGS. 7-11 are diagrams of the apparatus of FIG. 2, illustrating the pin in a multiple positions relative to the first track and the second track. The biasing mechanism 62 (FIG. 6) is not shown in FIGS. 7-11 in order to provide clear views of the appendage 14, pin 26, first track 32 and second track 46. FIG. 7 is a diagram of the apparatus for wiping of FIG. 2, illustrating the pin in a home position. In an embodiment, the pin 26 in a home position 64 engages the appendage's top portion 42, the first track's first vertical portion 34, and the second track's vertical portion 48. In an embodiment, the pin 26 will rest in the home position 64 when the shuttle 6 is idle, or pausing between shuttle passes. When the pin 26 is in the home position 64, the wiper arm 28 is in a retracted position relative to the drop detector 22 and the entrance slot 24.

Figure 8:
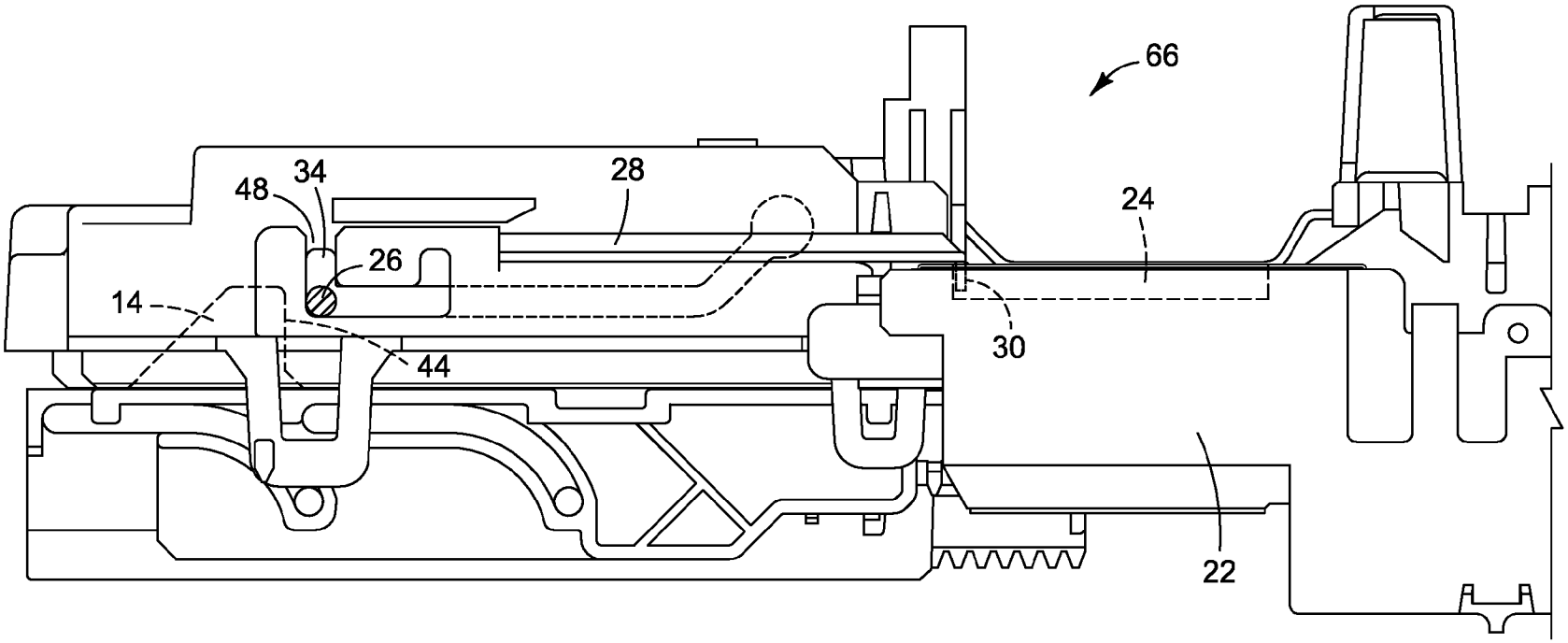
FIG. 8 is a diagram of the apparatus for wiping of FIG. 2, illustrating the pin in an activated position.

FIG. 8 is a diagram of the apparatus for wiping of FIG. 2, illustrating the pin in an activated position. In the exemplary embodiment, the pin 26 in an activated position 66 engages the first track's first vertical portion 34 and the second track's vertical portion 48, and is forward of or engaging the appendage's vertical portion 44. In an embodiment, the pin 26 is in the activated position 66 after the shuttle 6 begins its forward movement after having been idle or after having just completed a rearward pass. When the pin 26 is in the activated position 66, the wiper arm 28 is in a retracted position relative to the drop detector 22 and the entrance slot 24.

Figure 9:
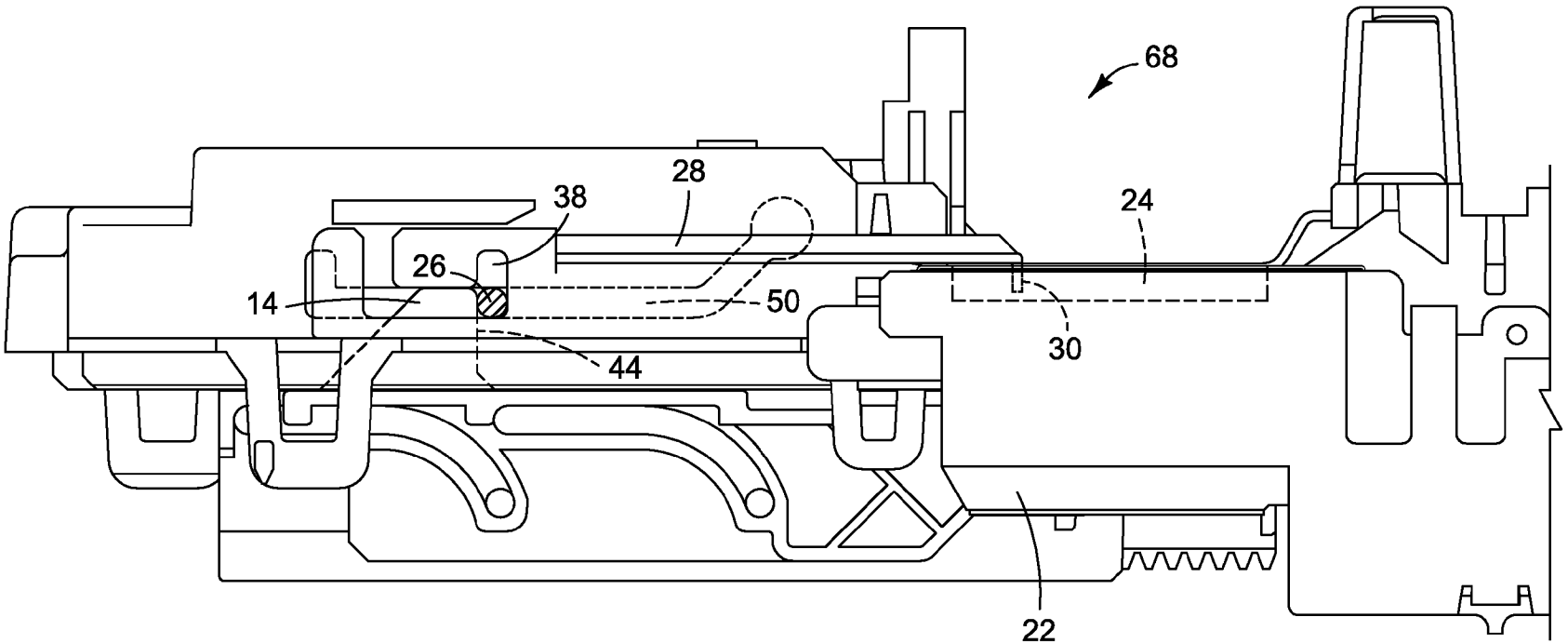
FIG. 9 is a diagram of the apparatus for wiping of FIG. 2, illustrating the pin in a first driving position.

FIG. 9 is a diagram of the apparatus for wiping of FIG. 2, illustrating the pin in a first driving position. In the exemplary embodiment, the pin 26 in a first driving position 68 engages the appendage's vertical portion 44, the first track's second vertical portion 38, and the second track's horizontal portion 50. In an embodiment, the pin 26 is in the first driving position 68 after the pin 26 moves from the activated position 66 across the first track's horizontal portion 36 so as to engage the first track's second vertical portion 38. When the pin 26 is in the first driving position 68, the wiper arm 28 engages the pin 26. As the appendage 14 moves the pin 26 forward, the pin 26 drives the wiper arm 28 that was in a retracted position and extends the wiper arm 28 towards the drop detector 22 and the entrance slot 24.

Figure 10:
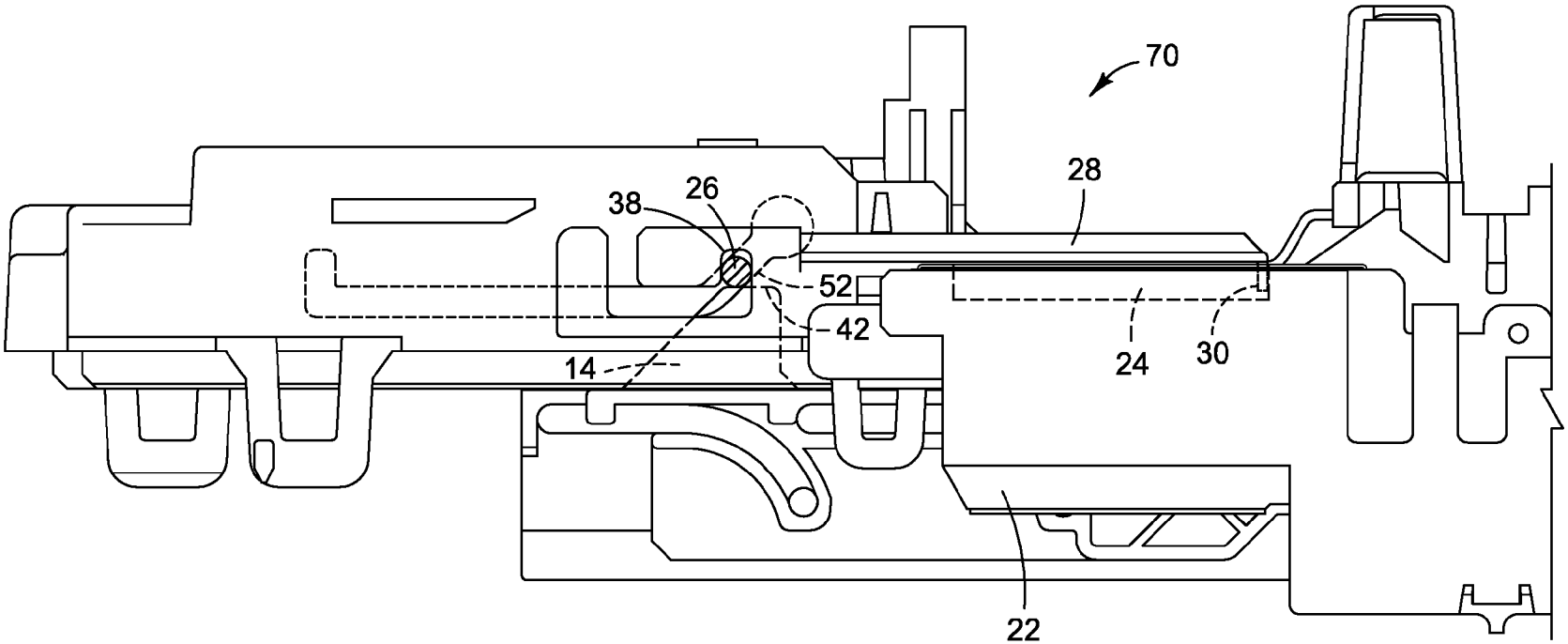
FIG. 10 is a diagram of the apparatus for wiping of FIG. 2, illustrating the pin in a forward position.

FIG. 10 is a diagram of the apparatus for wiping of FIG. 2, illustrating the pin 26 in a forward position 70. In the exemplary embodiment, a pin 26 in a forward position 70 can engage the appendage's top portion 42, the first track's second vertical portion 38, and the second track's ramp portion 52. In an embodiment, the pin 26 in the forward position 70 moves from the first driving position 68 forward across the second track's horizontal portion 50 so as to engage the second track's ramp portion 52. When the pin 26 engages the ramp portion 52, the slope of the ramp portion 52 causes the pin 26 to travel up the face of the appendage's vertical portion 44, and then to engage the appendage's top surface. The appendage 14 moves past the pin 26 causing the wiper arm 28 to cease moving. Thus, when the pin 26 is in the forward position 70, the wiper arm 28 by this point has been fully extended and has wiped the drop detector 22 and entrance slot 24.

In the exemplary embodiment, after the pin 26 has reached the forward position 70 the shuttle 6 and appendage 14 continue moving forward to cause the pin 26 to travel down the appendage's sloped ramp portion 40. In an embodiment, the slope of the ramp portion 40 can be, for example, approximately forty-five degrees. Downward component force of the biasing mechanism 62 (FIG. 6) causes the pin 26 to drop from the first track's second vertical portion 38 to the first track's horizontal portion 36, and allows a biasing mechanism 62 (FIG. 6) attached to the pin 26 to retract the pin 26 rearward along the first track's horizontal portion 36 and the second track's horizontal portion 50 so that the pin 26 will engage the first track's first vertical portion 34. The use of a biasing mechanism 62 (FIG. 6) causes the wiper arm 28 to be pulled rearward after the pin 26 passes over the top portion 42 of the appendage 14. Without the biasing mechanism 62 (FIG. 6), the presence of the horizontal portion 36 of the first track 32 would cause a delay in retracting the wiper arm 28 until the shuttle 6 reverses course and the appendage's ramp portion 40 begins pushing the pin 26 rearward. In an embodiment the biasing mechanism 62 (FIG. 6) includes a spring attached to the pin 26 and to an anchor, the anchor being part of the bonnet 4 structure.

In an embodiment, no biasing mechanism is used, such that there is a delay in retracting the wiper arm 28 until the shuttle 6 reverses course and the appendage's ramp portion 40 begins pushing the pin 26 rearward.

Figure 11:
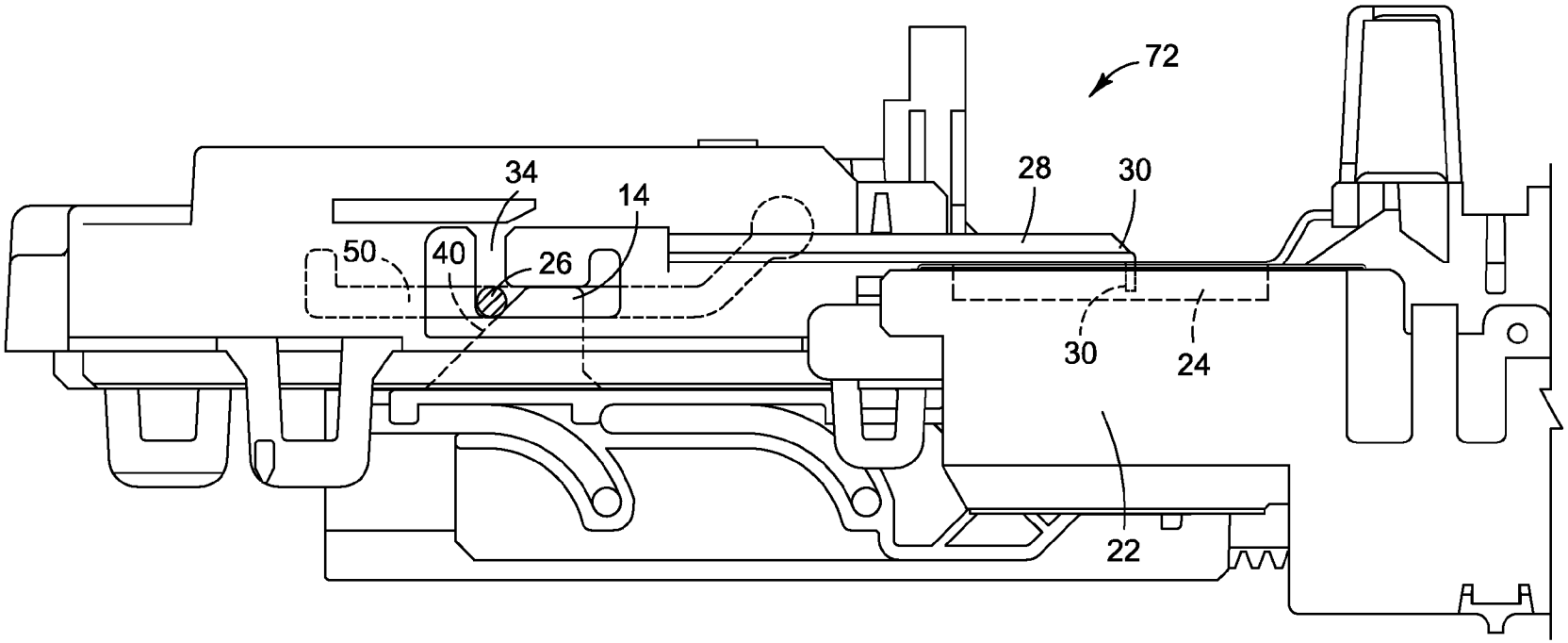
FIG. 11 is a diagram of the apparatus for wiping of FIG. 2, illustrating the pin in a second driving position.

FIG. 11 is a diagram of the apparatus for wiping of FIG. 2, illustrating the pin 26 in a second driving position 72. The pin 26 in a second driving position 70 can engage the appendage's ramp portion 40, the first track's first vertical portion 34 and the second track's horizontal portion 50. In an embodiment, the pin 26 in the first driving position 68 moves from the forward position 70 across the first track's horizontal portion 36 so as to engage the first track's first vertical portion 34. When the pin 26 is in the second driving position 70, the wiper arm 28 is engaged by the pin 26, and as the appendage 14 moves the pin 26 rearward, the pin 26 will engage the wiper arm 28 and retract the wiper arm 28 away from the drop detector and the entrance slot.

Figure 12:
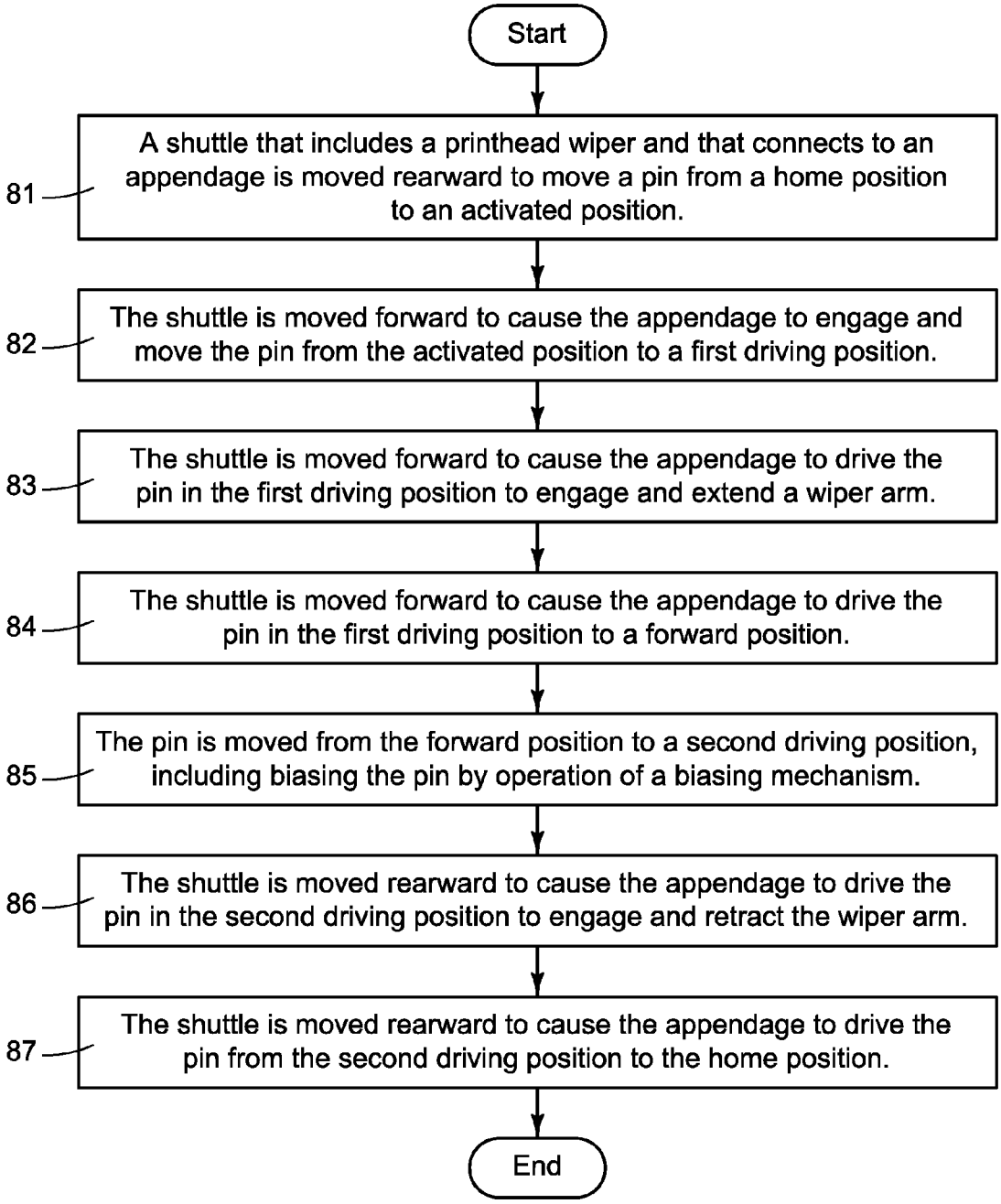
FIG. 12 is a flow chart of one embodiment of a method for wiping.

FIG. 12 is a flow chart of one embodiment of a method for wiping. The method of FIG. 12 begins at block 81, in which a shuttle that includes a printhead wiper and that connects to an appendage is moved rearward to move a pin from a home position to an activated position. In an embodiment the shuttle is actuated by a pinion-rack-gear system. The pin begins this step in a home position, in which the pin engages the appendage's top portion, the first track's first vertical portion, and the second track's vertical portion. At the end of this step the pin ends in an activated position, engaging the first track's first vertical portion and the second track's vertical portion, and forward of or engaging the appendage's vertical portion.

The method continues at block 82, in which the shuttle is moved forward to cause the appendage to engage and move the pin from the activated position to a first driving position. In the exemplary embodiment, the pin in a first driving position engages the appendage's vertical portion, the first track's second vertical portion, and the second track's horizontal portion.

The method continues at block 83, in which the shuttle is moved forward to cause the appendage to drive the pin in the first driving position to engage and extend a wiper arm. In an embodiment this causes a wiper arm to extend to wipe a drop detector, and the printhead wiper to wipe the printhead, both occurring during the same shuttle pass. As used in this specification and the appended claims, a "shuttle pass" means one shuttle trip forward or rearward along the X-axis. In an embodiment, a shuttle pass includes one shuttle trip from the shuttle home position to a shuttle front hardstop position (a forward hardstop position at the end of the service station opposite the shuttle home position where printhead wiping and capping occurs), or one shuttle trip rearward along the X-axis from the shuttle front hardstop position to the shuttle home position.

The method continues at block 84, in which the shuttle is moved forward to cause the appendage to drive the pin in the first driving position to a forward position. In the exemplary embodiment, a pin in a forward position engages the appendage's top portion, the first track's second vertical portion, and the second track's ramp portion. When the pin is in the forward position, the wiper arm is in its fully extended position and has wiped the drop detector.

The method continues at block 85, in which the pin is moved from the forward position to a second driving position, including biasing the pin by operation of a biasing mechanism. At the end of this step the pin is in a second driving position, engaging the appendage's ramp portion, the first track's first vertical portion and the second track's horizontal portion. In an embodiment when the pin reaches the forward position, the shuttle and appendage continue forward and the appendage disengages from the pin, allowing the pin to descend to the second ramp's horizontal portion through the downward component force of the biasing mechanism. The rearward component force of the biasing mechanism begins moving the pin rearward. The shuttle and appendage reverse course so as to travel rearward, and the appendage's first portion reengages the pin to continue moving the pin rearward.

The method continues at block 86, in which the shuttle is moved rearward to cause the appendage to drive the pin in the second driving position to engage and retract a wiper arm. This causes the wiper arm to move rearward from the extended position to and thereby uncover the entrance slot so that the drop detector is ready for use.

The method continues at block 87, in which the shuttle is moved rearward to cause the appendage to drive the pin from the second driving position to the home position. In an embodiment the shuttle ceases its rearward motion and pauses when the pin reaches the home position. When the pin is in the home position, the wiper is in its fully retracted state.

Figure 13:
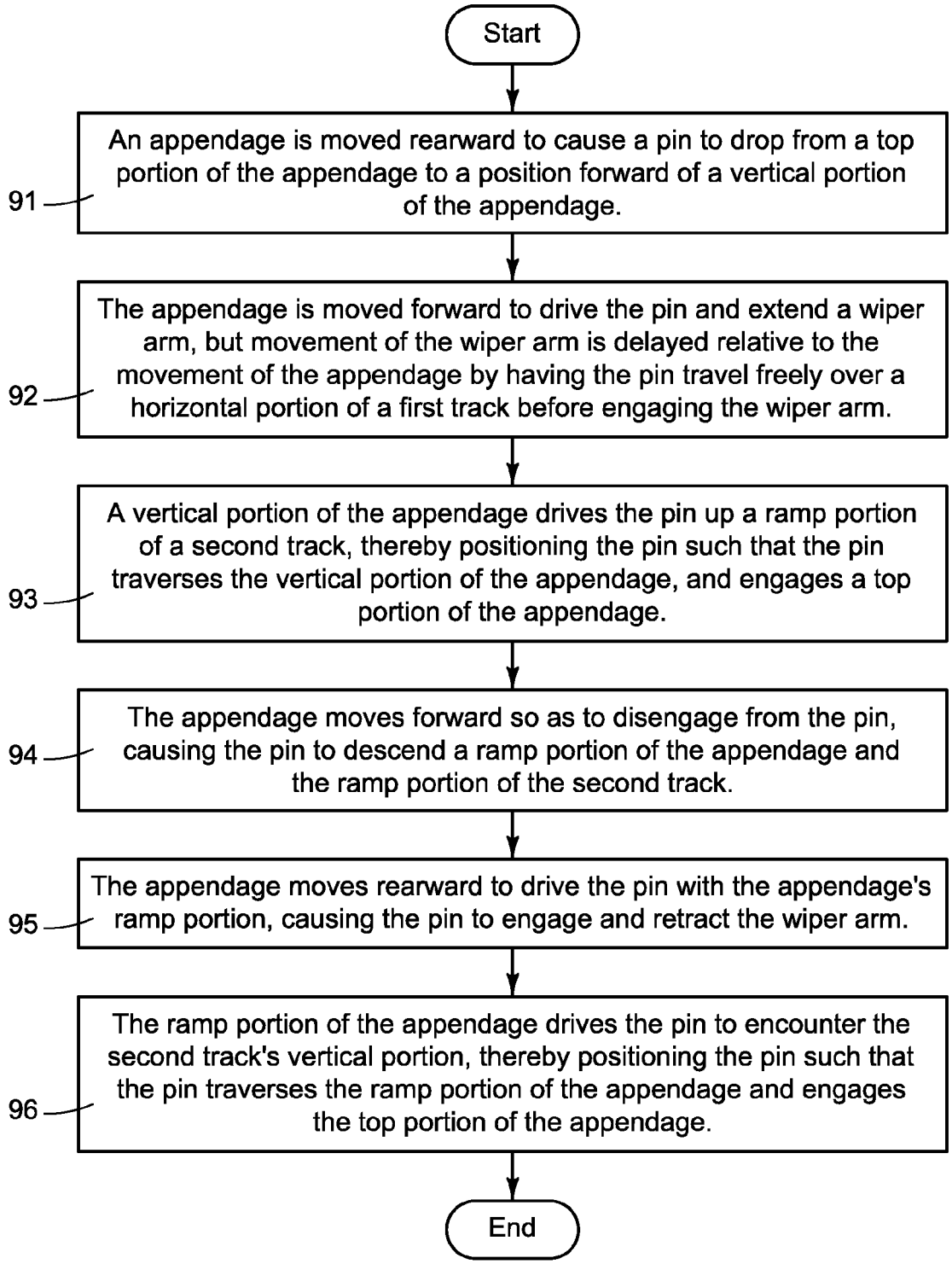
FIG. 13 is a flow chart of one embodiment of a method for wiping.

FIG. 13 is a flow chart of one embodiment of a method for wiping. The method begins at block 91, in which an appendage is moved rearward to cause a pin to drop from a top portion of the appendage to a position forward of a vertical portion of the appendage. This movement accomplishes moving the pin from a home position to an activated position.

The method continues at block 92, in which the appendage is moved forward to drive the pin and extend a wiper arm, but movement of the wiper arm is delayed relative to the movement of the appendage by having the pin travel freely over a horizontal portion of a first track before engaging the wiper arm.

The method continues at block 93, in which the vertical portion of the appendage drives the pin up a ramp portion of a second track, thereby positioning the pin such that the pin traverses the vertical portion of the appendage, and engages the top portion of the appendage. This movement accomplishes moving the pin from a first driving position to a forward position, a position of transition for the pin after its forward movement, and just prior to rearward movement. At this point the wiper arm is fully extended.

The method continues at block 94, in which the appendage moves forward so as to disengage from the pin, causing the pin to descend a ramp portion of the appendage and the ramp portion of the second track. This movement accomplishes moving the pin from a forward position to a position in the second track's horizontal portion, ready for the pin to reengaged by the appendage's first portion when the appendage reverses course to travel in a rearward direction. In an embodiment the pin begins its rearward trip prior to being reengaged by the appendage by virtue of a biasing mechanism that pulls the pin rearward after the appendage traveling forward disengages from the pin.

The method continues at block 95, in which the appendage moves rearward to drive the pin with the appendage's ramp portion, causing the pin to engage and retract the wiper arm. The pin is in the second driving position during this movement.

The method continues at block 96, in which the ramp portion of the appendage drives the pin to encounter the second track's vertical portion, thereby positioning the pin such that the pin traverses the ramp portion of the appendage and engages the top portion of the appendage. This movement accomplishes moving the pin from the second driving position to the home position. At the end of this step the wiper arm is in a fully retracted position.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. An apparatus for wiping, comprising:
- a movable wiper arm, including
  - a wiping end to wipe a drop detector, and
  - a first track;
- a second track;
- a movable pin, configured to simultaneously travel within the first track and the second track between a plurality of positions including
- a first position in which the pin engages a first vertical portion of the first track to extend the wiper arm, and
- a second position in which the pin engages a second vertical portion of the first track to retract the wiper arm; and
- an appendage connected to a movable shuttle, the appendage to engage and urge the pin simultaneously along the first and second tracks between the plurality of positions.

2. The apparatus for wiping of claim 1, wherein the first track includes a horizontal portion between the first vertical portion and the second vertical portion.

3. The apparatus for wiping of claim 1, wherein the second track includes:
- a vertical portion;
- a horizontal portion; and
- a ramp portion.

4. The apparatus for wiping of claim 1, wherein the appendage further includes:
- a ramp portion with a slope of approximately forty-five degrees with respect to a long axis of the wiper arm;
- a top portion that is substantially parallel to the long axis of the wiper arm; and
- a vertical portion with a slope of approximately ninety degrees with respect to the long axis of the wiper arm.

5. The apparatus for wiping of claim 1, wherein the second track is connected to a bonnet.

6. The apparatus for wiping of claim 1, wherein the shuttle includes a printhead wiper.

7. The apparatus for wiping of claim 6, wherein the shuttle includes a printhead cap.

8. The apparatus for wiping of claim 1, further comprising a biasing mechanism connected to the pin.

9. A service station, comprising:
- a drop detector;
- a movable wiper arm, including
  - a wiping end to engage the drop detector, and
  - a first track;
- a second track;
- a movable pin configured to simultaneously travel within the first track and the second track between a plurality of positions including
  - a first position in which the pin engages a first vertical portion of the first track to extend the wiper arm, and
  - a second position in which the pin engages a second vertical portion of the first track to retract the wiper arm;
- a movable shuttle having an appendage, the appendage to engage and urge the pin simultaneously along the first and second tracks between the plurality of positions.

10. The service station of claim 9, further comprising a biasing mechanism to connect to the pin.

11. The service station of claim 9, wherein the shuttle further includes a printhead cap.

12. The service station of claim 9, wherein the first track further includes a horizontal portion between the first vertical portion and the second vertical portion.

13. The service station of claim 9, wherein the second track includes:
- a vertical portion;
- a horizontal portion; and
- a ramp portion.

14. The service station of claim 9, wherein the appendage further includes:

a ramp portion with a slope of approximately forty-five degrees with respect to a long axis of the wiper arm;

a top portion that is substantially parallel to the long axis of the wiper arm; and a vertical portion with a slope of approximately ninety degrees with respect to the long axis of the wiper arm.

15. The service station of claim 9, wherein the shuttle further includes a printhead wiper.

16. The apparatus of claim 1, wherein first track is situated parallel to the second track.

17. The apparatus of claim 1, wherein the pin includes a cylindrical portion that operatively engages, and is configured to roll simultaneously within, at least portions of the first and second tracks.

* * * * *